United States Patent [19]

Meyer

[11] 3,997,157

[45] Dec. 14, 1976

[54] COMPETITIVE SKILL-TYPE GAME

[75] Inventor: Burton C. Meyer, Downers Grove, Ill.

[73] Assignee: Marvin Glass & Associates, Chicago, Ill.

[22] Filed: Feb. 18, 1976

[21] Appl. No.: 659,147

[52] U.S. Cl. ..... 273/1 R; 46/44; 46/127; 46/128

[51] Int. Cl.[2] ..... A63F 9/00

[58] Field of Search ..... 273/1 R; 46/44, 118, 46/127, 128, 142, 143, 235, 236

[56] References Cited

UNITED STATES PATENTS

| | | | |
|---|---|---|---|
| 1,812,930 | 7/1931 | Chester | 46/143 |
| 2,623,326 | 12/1952 | Kinney | 46/235 |
| 2,716,840 | 9/1955 | Armstrong | 46/142 |
| 2,937,025 | 5/1960 | Bellak | 46/127 X |
| 2,981,032 | 4/1961 | Montgomery | 46/127 |
| 2,988,847 | 6/1961 | Smith | 46/127 X |
| 3,106,800 | 10/1963 | Fletcher | 46/236 |
| 3,235,259 | 2/1966 | Glass et al. | 46/118 X |
| 3,730,520 | 12/1971 | Cooper | 273/1 R |
| 3,864,870 | 2/1975 | Breslow et al. | 46/142 |

*Primary Examiner*—William H. Grieb
*Attorney, Agent, or Firm*—Coffee and Sweeney

[57] ABSTRACT

A competitive skill-type game including a figure toy horse which is pivotally mounted to a base to simulate bucking or jumping similar to a bucking bronco of a rodeo contest. A figure toy cowboy is provided for removable mounting on a saddle of the horse and includes a pair of pivotally mounted legs for grasping the body of the horse. Two independent selectively actuatable devices are provided, one for each player of the game, one to cause the horse to pivot about its mounting in a bucking manner and one to cause the legs of the cowboy figure toy to engage the sides of the horse. The players compete in an attempt to simulate a rodeo contest where a rider attempts to ride the horse for a predetermined period of time which is calculated by a timer provided on the base. One of the players of the game operates one of the actuation devices to cause the horse to pivot in a bucking manner in an attempt to "throw" the rider from the horse. Simultaneously, the other player operates the other actuation device in an attempt to cause the legs of the rider to grasp the horse during each bucking or pivoting motion caused by the first player in an attempt to cause the rider to remain on the horse for the length of time determined by the timer.

9 Claims, 7 Drawing Figures

4
4
3
3
A
A

COMPETITIVE SKILL-TYPE GAME

BACKGROUND OF THE INVENTION

1. Field of the Invention

The present invention relates to competitive type skill games and, more particularly, to a skill game of the type where two or more figures are independently controlled by the opposing players of the game.

2. Description of the Prior Art

Over the years, there have been a number of devices for toys or games wherein two or more figures are controlled by respective players during competition in a particular event. Fighting type games are typical of this type whereby the figures may be made to undergo controlled, compound movement relative to a base and to each other in an attempt to strike the figure of the opposing player. Means also have been provided whereby, when one of the figures strikes a blow on the other figure at a predetermined position thereon, some particular type of action designating such a hit will occur so as to signal the achievement of a point or the end of a fight. Typical of the prior art of this type is U.S. Pat. No. 3,864,870 for a Fighting Figure Toy.

SUMMARY OF THE INVENTION

It is the object of the present invention to provide a new and improved competitive skill-type game wherein two or more figures are associated with player actuators for controlled movement of the figures by the players to simulate a contest.

The exemplary embodiment of the present invention achieves the following object in a structure including a base having a first figure, a horse, mounted for movement thereon and a second figure, a rider, for mounting on the horse for movement therewith. A first player actuator is connected to the pivotally mounted horse to cause it to pivot about its mounting in an attempt to eject the rider mounted thereon. A second player actuator is connected to the mounted rider and operates a grasping device including the legs of the rider which engages the torso of the horse in an attempt to remain mounted on the first figure. Thus, by simultaneous operation of the player actuators, one player may attempt to eject the rider from the horse similar to a bucking bronco contest of a rodeo while the other player attempts to maintain the rider mounted on the horse. A timer is provided in the base for presetting a predetermined time period through which the rider must stay mounted on the horse.

Other objects, features and advantages of the invention will be apparent from the following detailed description taken in connection with the accompanying drawings.

DESCRIPTION OF THE PREFERRED EMBODIMENT

Figures 1, 2, 3:
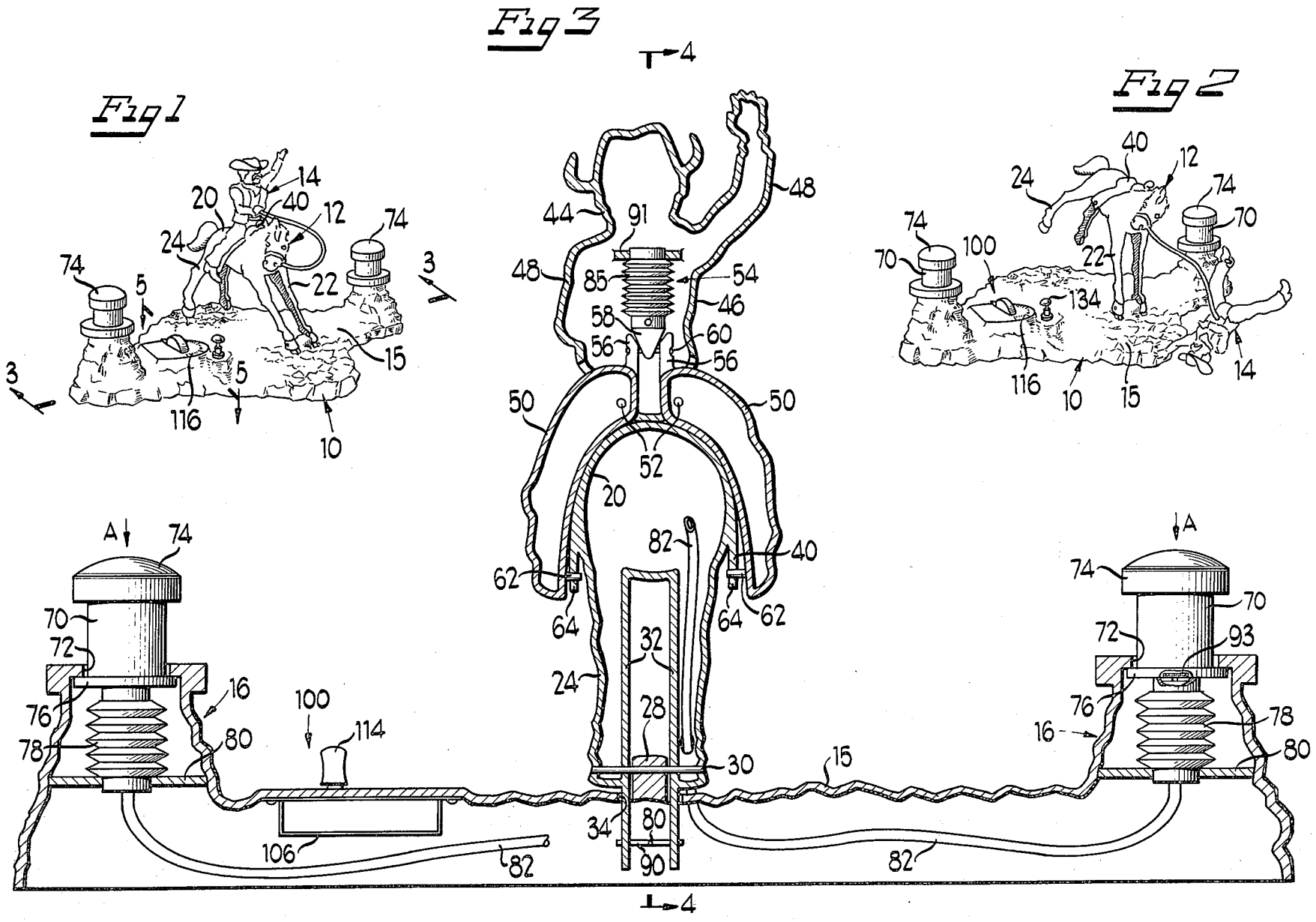
FIG. 1 is a perspective view of the competitive game made in accordance with the present invention showing the rider mounted on the horse.
FIG. 2 is a perspective view similar to FIG. 1 showing the rider after he has been thrown by the horse.
FIG. 3 is a vertical section, on an enlarged scale, taken generally along line 3—3 of FIG. 1.

An exemplary embodiment of the competitive skill-type game made according to the invention is illustrated in the drawings and, with reference to FIGS. 1 and 2, is seen to include a generally irregularly shaped base, generally designated 10, mounting a normally upright first figure toy 12 and a second figure toy thereon, generally designated 14. More specifically, the figure toy 12, as shown, appears as a horse, which is mounted for pivotal movement on the base and the second figure toy appears as a cowboy or rider on the horse and is removably mounted to the horse by means to be described in greater detail hereinafter.

Figure 4:
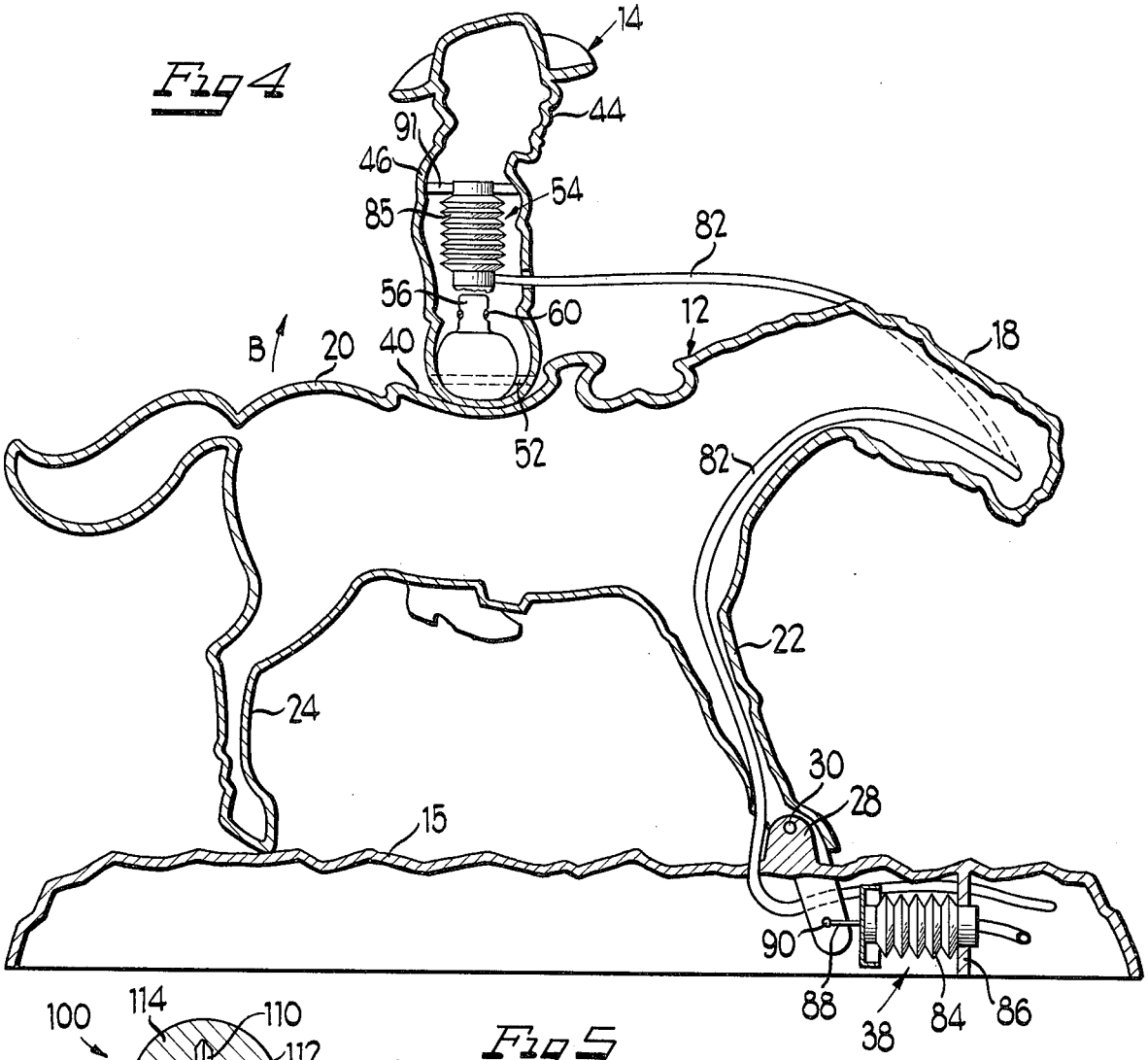
FIG. 4 is another vertical section, taken generally along line 4—4 of FIG. 3.

With reference to FIGS. 3 and 4, the base 10 includes a very irregular upper, generally convex surface 15, simulating an area of rough terrain including two integrally molded, simulated turf contours, generally designated 16, at opposite ends thereof. The horse 12 includes a head 18, a torso portion 20, and front and rear legs 22 and 24, respectively. The front legs 22 of the horse are pivotally mounted to the base by an upstanding boss 28 on the base and a pin 30 through an appropriate aperture in the legs 22 and boss 28. Preferably, the ends of the pin 30 are secured to the legs 22 of the horse as by an adhesive or the like to prevent removal thereof. The inner surfaces 32 (FIG. 3) of the front legs 22 extend through slots 34 in the top surface 15 of the base for connection to a first selectively operable actuation means, generally designated 38, to be described in detail hereinafter.

The rider 14 is removably mounted to a saddle 40 provided about the torso of the horse and preferably is molded integrally therewith. The rider 14 includes a head 44, a torso 46, a pair of arms 48 and a pair of pivotally mounted legs 50. The legs 50 are secured by a pair of pivot pins 52 to the lower end of the torso as shown in FIG. 3. The legs are provided with this pivotal mounting arrangement to permit grasping about the torso 20 of the horse on the saddle 40 as they are urged towards one another by a biasing means or second actuating means generally designated 54 on the interior of the torso. The upper inner end of each leg 50 includes a generally vertical tab 56 which engages a movable wedge 58 mounted on the actuator 54. The upper tabs 56 are urged toward one another by resilient means in the form of a rubberband 60 stretched around their upper ends to constantly urge the legs to a spread position. The bottom of each leg is provided with a generally horizontal pin 62 which will engage an appropriate aperture formed in a pair of stirrups 64 of the saddle 40.

The first and second selectively operable actuation means 38 and 54 include substantially identical components and like numbers will be used to identify like components. More particularly, each selectively operable actuation means includes a manually operable plunger 70 which is slidably mounted in an aperture 72 formed in the top of the elevated turf portions 16 on either end of the frame 10. A generally convex dome or head 74 is provided on the top of the plunger 70 to limit its downward travel by engagement with the frame 10. A peripheral circular flange 76 is provided about the bottom of the plunger 70 to limit the upper travel thereof. A compressible chamber in the form of an accordion-type air bellows 78 is mounted below each plunger 70 by a generally horizontal rib 80 on the frame 10 so that downward pressure or force on each plunger, in the direction of arrow A (FIG. 3), causes the bellows 78 to collapse. Each bellows 78 is in fluid communication by a hose 82 to a second compressible accordion-type air chamber 84.

The second air chamber 84 for the first actuation means 38 is mounted to a generally vertical flange 86 on one end and pivotally connected by a shaft 88 on the other end to a pin 90 between the inner surfaces 32 of the front legs of the horse. Thus, upon depressing or actuation of the first selectively operable actuation means, the respective bellows 84 on the base will expand causing the horse 12 to pivot upwardly about the pin 30 in the direction of arrow B, as shown in FIG. 4. This upward generally rapid pivotal movement of the horse 12 will impart momentum to the rider 14 and tend to "throw" the rider from the horse. The player who is operating the first selectively operable actuation means thus will attempt to cause the horse to throw the rider to successfully win the contest.

The other player will attempt to prevent the rider from being thrown from the horse by operation of the second selectively operable actuation means 54. More particularly, the compressible chamber 78 therefor is connected to its respective expandible chamber 85 mounted on a flange 91 within the torso of the rider 14. The wedge 58, previously described, is mounted on the movable end of the chamber 85 so that upon depressing of the plunger 70 the wedge will be forced downwardly between the generally vertical tabs 56 on the legs to move them apart slightly causing the legs to grasp the torso 20 of the horse and cause the pins 62 on the ends of the legs to engage the apertures in the stirrups 64. Releasing of the plunger on the second actuation means allows the wedge portion 58 to retract from between the tabs 56 under the force of the rubberband 60 to spread the legs about their pivot points 52.

Thus, it can be seen, that the competitive skill-type game simulates the rodeo activity of riding a bucking horse wherein the object of one player is to attempt to throw the rider from the horse by causing the horse to pivot or "buck" while the object of the second player is to attempt to prevent the rider from being thrown by causing the legs 50 to grasp the saddle and stirrups 64 each time the horse bucks.

A generally porous washer 93 is provided in the upper end of each compressible chamber 78 to provide a slow pressure release of the air within the chamber 78 to the exterior environment. The porous washer adds an additional element of skill to the game since, for example, it prevents a player from holding the plunger 70 associated with the rider 14 in a downward position in an attempt to maintain the legs 50 in their locked position. If this method is attempted to maintain the legs 50 of the rider in a locked position, the air within the system will slowly release through the porous washer 90 and the resilient band 60 will cause the legs to disengage with the stirrups 64.

Figure 5:
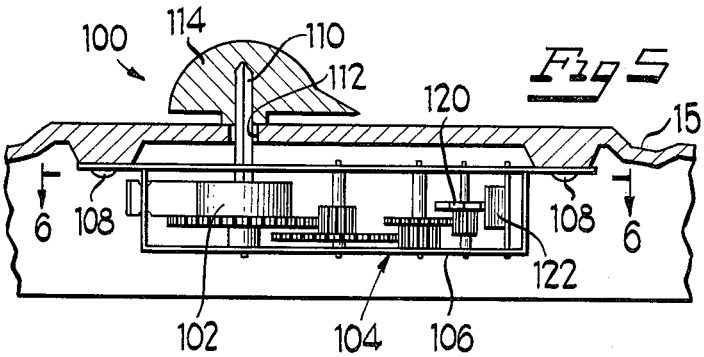
FIG. 5 is a vertical section, on an enlarged scale, taken generally along line 5—5 of FIG. 1.

A timer, generally designated 100, is mounted on the base 10 to permit the players to set a predetermined time interval during which a contest begins and ends. The timer 100 used in the preferred embodiment is calculated to provide a maximum time period of approximately 15 seconds and includes a typical spring wound motor 102 (FIG. 5) connected to an Aladdin release mechanism, generally designated 104. The Aladdin release mechanism 104 is mounted within a rectangular frame 106 to the bottom surface of the frame wall 15 by a pair of screws 108 or the like. A square cross section winding shaft 110 extends generally vertically through an aperture 112 in the frame 15 for mounting a wind-up knob 114 which also serves as a pointer in conjunction with a scale 116 on the top of the housing. The scale 116 includes a plurality of markings, for example, each indicating an elapse of 1 second for the timer. The Aladdin release mechanism includes a star wheel 120 associated with a pivotal, elongated leaf member 122 which must be free to move at all times in order for the timer to continue running. Any interference with the leaf member 122 will stop the timer 100.

Figure 7:
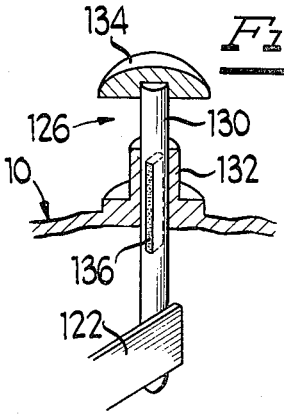
FIG. 7 is a fragmentary perspective view of the timer stop contemplated by the present invention.
Figure 6:
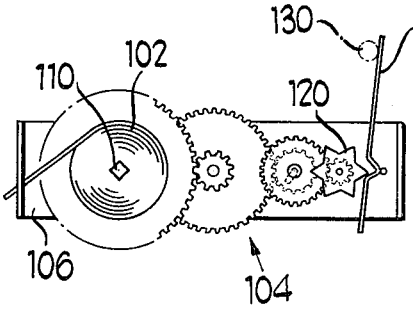
FIG. 6 is a horizontal section taken generally along line 6—6 of FIG. 5.

A slidably mounted plunger, generally designated 126 (FIG. 7), is provided to engage the leaf member 122 in order to stop the timer 100. More particularly, the plunger includes a generally vertical shaft 130 which is slidably mounted for vertical reciprocal movement in a boss 132 formed on the top of the base 10. The plunger includes a handle or head 134 to facilitate finger grasping thereof so that the plunger can be pushed downwardly to engage the leaf member 122 and stop the Aladdin timer 100 after, for example, the rider has been thrown by the horse. Upward movement of the plunger 130 out of engagement with the leaf member 122 will permit the timer 100 to continue to rotate. A resilient, rubber strip 136 is mounted within a rectangular slot formed in the plunger shaft 130 and extends slightly past the surfaces thereof to increase the frictional engagement between the plunger 130 and the boss 132 to assure adequate friction to maintain the plunger 130 in its up or down position.

In a typical contest, the timer 100 is set to a predetermined time period, such as ten seconds, and the players begin a contest after starting the timer. One of the players associated with the horse 12 attempts to throw the rider by causing the horse to pivot. The other player then attempts to prevent the rider from being thrown by successive timed actuation of the second actuator in relation to the pivotal movement of the horse in an attempt to always have the legs 50 of the rider engaged within the stirrups 64 during a jerky upward movement of the horse. If the rider is successfully thrown from the horse, the player associated with the first actuator is declared the winner. However, if the rider remains mounted on the horse after the total amount of time set on the timer has elapsed, the player associated with the second actuator is declared the winner.

The foregoing detailed description has been given for clearness of understanding only and no unnecessary limitations should be understood therefrom as some modifications will be obvious to those skilled in the art.

I claim:

1. A competitive skill type game, comprising:

a base support;

a first figure toy mounted on said base support for movement relative thereto;

a first actuating means operatively associated with said first figure toy and selectively operable by one player of the game for causing irregular movement of said first figure toy relative to said base support;

a second figure toy positionable on said first figure toy and including latch means therebetween but normally biased out of engagement to permit the second figure toy to be thrown from said first figure toy in response to said selective irregular movement thereof; and a second actuating means operatively associated with said second figure toy and operably by a second player for intermittently engaging said latch means to prevent the second figure to be thrown from said first figure toy.

2. The game of claim 1 wherein the latch means for said second figure toy includes at least a pair of clamp members for embracing said first figure toy and including biasing means for urging said clamp members out of engagement with said second figure toy.

3. The game of claim 2 wherein said first figure toy is in the form of a horse and said clamp members comprise leg portions of a simulated rider.

4. The game of claim 3 wherein said second actuating means includes a pneumatic chamber within said simulated rider for urging the leg portions thereof in clamping relationship against said horse.

5. The game of claim 4 wherein said pneumatic chamber includes a release valve to prevent said one player from constantly urging said leg portions of the rider against the horse.

6. The game of claim 3 including a pneumatic chamber operatively associated with said horse and intermittently operable by said second player of the game for moving the horse relative to said base support.

7. The game of claim 6 wherein said second actuating means includes a pneumatic chamber within said simulated rider for urging the leg portions thereof in clamping relationship against said horse.

8. The game of claim 7 wherein said pneumatic chamber includes a release valve to prevent said one player from constantly urging said leg portions of the rider against the horse.

9. The game of claim 1 including a timer on said base support to establish a finite interval of time within which said players are to compete.

* * * * *